United States Patent [19]

Todokoro

[11] 4,119,312

[45] Oct. 10, 1978

[54] GAME BOARD

[76] Inventor: Masatoshi Todokoro, 2-33, Kognaehara 2-chome, Matsudo, Chiba, Japan, 270

[21] Appl. No.: 763,691

[22] Filed: Jan. 28, 1977

[51] Int. Cl.[2] ..... A63F 9/00

[52] U.S. Cl. ..... 273/1 R; 273/120 R

[58] Field of Search ..... 273/1 R, 1 E, 1 M, 118 R, 273/118 A, 118 D, 119 R, 119 A, 119 B, 120 R, 120 A, 123 R, 123 A, 86 R; 35/22 R

[56] References Cited

U.S. PATENT DOCUMENTS

| | | | |
|---|---|---|---|
| 3,594,000 | 7/1971 | Glass et al. | 273/1 R X |
| 3,841,628 | 10/1974 | Goldfarb | 273/1 R |
| 3,841,629 | 10/1974 | Barlow | 273/1 R |
| 4,007,933 | 2/1977 | Cooper | 273/1 R X |

*Primary Examiner*—Paul E. Shapiro
*Attorney, Agent, or Firm*—George B. Oujevolk

[57] ABSTRACT

A game board for play by children, in which a pertinent number of booty capturing structures modeled after the head of an animal or otherwise shaped and operated by the respective players are rushed toward the center of the board from the peripheral parts thereof to try to capture booty such as a ball which is delivered to the center of the board before the game is started.

2 Claims, 4 Drawing Figures

GAME BOARD

This invention relates to a game board for play enjoyed by several children seated around the board, the game being played with the respective players handling levers to rush their booty capturing structures modeled after the head of an animal or likewise shaped toward the center of the board from the peripheral parts thereof (each of such peripheral parts being taken by a player) to try to capture booty such as a ball which is delivered to the center of the board before the game is started.

The invention is now described in detail by way of an embodiment thereof in conjunction with the accompanying drawings, in which.

Figure 1:
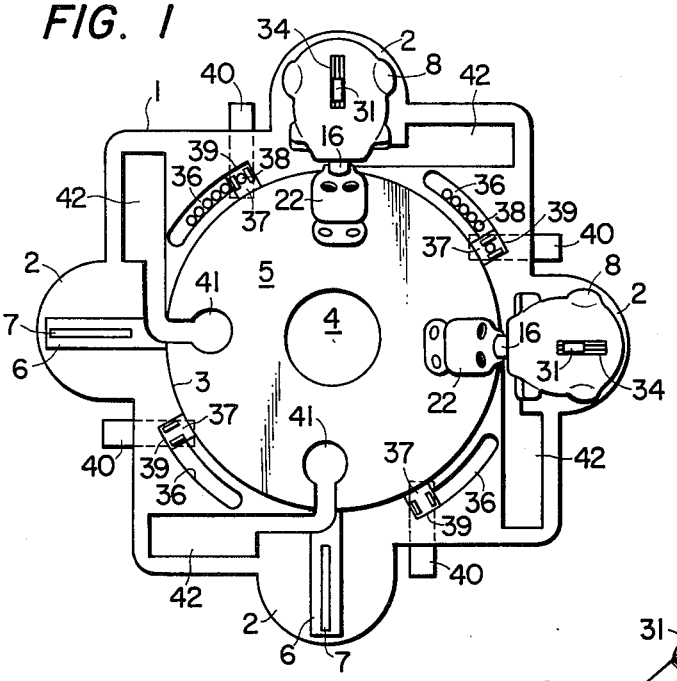
FIG. 1 is a top plan view, with parts eliminated, of a game board according to this invention.
Figure 2:
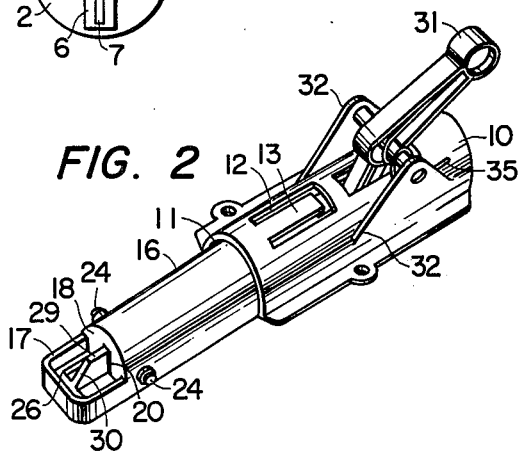
FIG. 2 is a perspective view showing an example of the ejection mechanism for ejecting a push-out member.

Referring generally to the drawings which illustrate a preferred embodiment of this invention, reference numeral 1 indicates a square base board having four equal sides and a proper height. Centrally of each side of said base board 1 is provided a half-circular bulge 2 which is so arranged that each pair of opposing bulges 2 are disaligned or slightly diverge from each other in their center lines. On the surface and toward the periphery of said board 1 is provided a stepped portion 3 describing a circle as shown. The annular board surface portion 5 extending from said circular stepped portion 3 to a circular plane portion 4 provided in the center of the board slopes down gently toward said plane portion 4. Centrally in the upper surface of each said bulge 2 is formed a slant groove 6 which leads into said annular board surface portion 5. The inclination of said groove 6 is smaller than that of the annular board surface 5. An elongated slot 7 is provided centrally in and along the center line of each said slant groove 6. Numeral 8 indicates a hollow structure having an external appearance resembling the body of an animal. This hollow structure 8 (hereinafter referred to as body portion) is fixedly mounted on the upper surface of each said bulge 2 and provided with an opening 9 at its end close to the stepped portion 3. Fixed in the inside of each said body portion 8 and on the upper surface of the corresponding bulge 2 is a frame 10 which is half-circular in sectional shape and so disposed as to bestride the slant groove 6. Said frame 10 is opened at its end close to the fore end of said body portion 8 as well as at its end close to the rear end of said body portion, and a protuberant edge 11 is provided at the inner wall of its fore end. The upper surface portion of said frame slants in the same direction as the groove 6. It will be also noted that a U-shaped hole 12 is cut in said frame 10, said hole extending from a position close to the fore end of the upper surface portion of said frame to a mid position thereof to form a projecting portion 13. At the distal end of said projecting portion 13 is provided a protuberance 14 projecting toward the groove 6. Also formed in said upper surface portion is an elongated hole 15 which extends from a position close to the rear end of said surface portion to a mid position thereof.

Reference numeral 16 indicates a thick push-out member half-circular in sectional shape, with the rear end side portion thereof being inserted into the corresponding frame 10 through the opening 9 in the associated body portion 8 while the distal end side portion projects out from said body portion 8. The bottom portion of said push-out member is slidably fitted in the corresponding slant groove 6. Projecting at the fore end of each said push-out member 16 is a small enclosed compartment or chamber 17 which is open at its upper side and provided with a bottom plate 19 at its underside. In the fore end plate 18 of said push-out member 16 is a cutout 20 extending from a central part of its lower end to an upper position to allow the inside of said push-out member 16 to communicate with the interior of said chamber 17. In the rear end of push-out member 16 is a pitfall 21. Numeral 22 indicates a hollow capturing structure shaped after the pattern of an animal head. This capturing structure (hereinafter referred to as captor) is open at its bottom 23 and pivoted at its rear end by a shaft 24 passed across the fore end of said push-out member 16 such that said small chamber 17 is positioned within said captor 22. In the inside of said captor 22 is provided a protuberance 25 extending close to the upper side of said small chamber 17. There is also provided an actuator plate 26 loosely fitted in the bottom of push-out member 16 so as to be movable reciprocatively toward and away from both fore and rear ends of said push-out member. The fore end portion of said actuator plate 26 is slidably placed on the bottom plate 19 of the small chamber 17 so that said plate 26 can reciprocate within the range of a space 28 defined between the fore end of said plate and the fore end plate 27 of the small chamber 17. On the upper side of the end of each said actuator plate 26 is a protuberant portion 29 which is cut at its fore end to form a bevel 30. This protuberant portion 29 is so designed that when the actuator plate 26 is moved toward the fore end of the push-out member 16, said protuberant portion enters into the small chamber 17 through the cutout 20 provided in the fore end plate 18 of said push-out member 16 and the bevel 30 hits against the end of the protuberance 25 in each said captor 22 to raise it up, pivoted by the shaft 24, from the surface of the board 1 to thereby open out the bottom opening 23 of the captor 22.

A lever 31 is provided for forcing out or pulling back the push-out member 16 from or into the corresponding body portion 8. This lever is pivotally supported at its middle part by a bearing 32 provided in the frame 10. The fore end portion of said lever extends through the elongated hole 15 in the frame 10, pitfall 21 in the push-out member 16, hole 33 formed in the rear end portion of the actuator plate 26 and elongated slot 7 formed in the bulge 2 of the base board 1, in that order, while the rear end portion of said lever extends through an elongated hole 34 formed in the top of the body portion 8 to project outwardly from said body portion. Said lever 31 is also loaded with a spring 35 adapted to press said lever such that the push-out member 16 is normally pulled into the body portion 8.

There are also provided in the board surface the gutter-like ball receptacles 36 each of which is located intermediate every adjoining body portions 8, 8 and in close proximity to the circular stepped portion 3. Each ball receptacle 36 has a port 37 leading into the annular slant board surface portion 5 inside the circular stepped portion 3, and the bottom surface of said receptacle is slanted down toward said port 37. Each ball receptacle 36 can contain a plurality of balls 38 therein. Each receptacle is also provided with a cutout 39 at its bottom portion contiguous to the port 37. Numeral 40 indicates a ball delivery lever so arranged that its end is movable up and down below said cutout 39. Its end portion is first lowered down and, after receiving a ball 38 rolling down along the slant bottom surface of the ball receptacle 36, the end portion is raised up to deliver the ball toward the center of the board surface 5. Also provided in the annular board surface portion 5 are the ball take-in hollows 41 each of which opens at the position where the associated captor 22, which has been pushed out by the push-out member 16, returns. At every corner of the board is provided a ball reservoir 42 connected to said ball take-in hollow 41.

Figure 3:
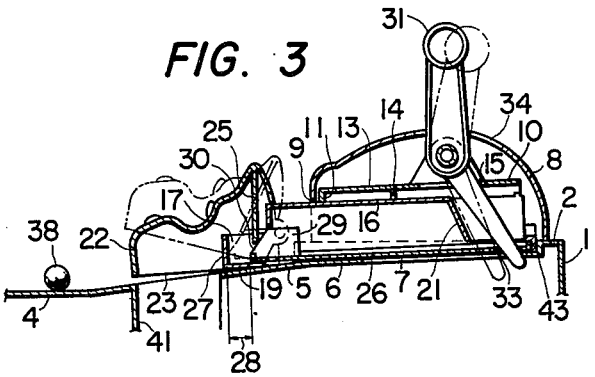
FIG. 3 is a sectional view of the ejection mechanism, showing a condition where the push-out member is held in its position in a hollow structure in the mechanism.
Figure 4:
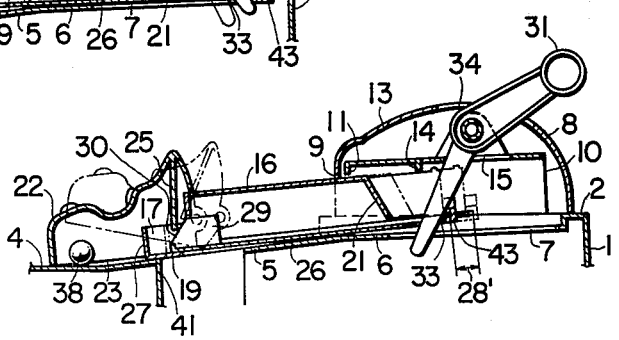
FIG. 4 is a similar view to FIG. 3 but showing a condition where the push-out member has been just ejected out of the hollow structure.

Now, the way to use the game board of this invention just described is explained. First, a ball 38 is delivered toward the center of the board from a ball receptacle 36 by operating the associated ball delivery lever 40. Then the players pull all together the levers 31 extending from the respective body portions 8 against the force of springs 35. Whereby the actuator plate 26 in each push-out mechanism moves from the rear end side toward the fore end side of the push-out member 16 so that the protuberance 29 at the end of said actuator plate 26 passes through the cutout 20 to enter the small chamber 17 and the end bevel 30 of said protuberance 29 hits against the protuberance 25 in the captor 22 to raise the captor 22 from the surface of the board 1, thereby opening out the open bottom 23 of said captor 22 as shown by dotted lines in FIG. 3. Then the foremost end of said actuator plate 26 pushes the end plate 27 of the small chamber 17 to force the push-out member 16 out of the body portion 8 toward the center of the board 1. In this push-out member force-out operation, the push-out member 16 is forced out with its top surface contacting the two spaced-apart protuberances 11 and 14 until the pitfall 21 formed close to the rear end of the upper surface of said push-out member 16 reaches the protuberance 14, so that said push-out member 16 is forced out with an inclination in conformity to the slant groove 6. But when said pitfall 21 reaches the protuberance 14, said protuberance 14 drops into said pitfall 21 and now the top surface of said push-out member 16 contacts only with the protuberant edge 11, so that, after that point, said push-out member 16 is forced out with its rear end raised and the fore end lower down. The foremost end continues to push the push-out member 16 and the end bevel 30 of the protuberance 29 keeps the captor in its raised-up position until the lever 31 is pulled to the limit of its movement as shown in FIG. 4. When the lever 31 reaches its limit position, the actuator plate 26 stops at the position shown by the dotted line in FIG. 4, but the push-out member 16 further advances, under the force of inertia, by the distance of the space 28′ left between the rear end plate 43 of the push-out member 16 and the rearmost end of the actuator plate 26. Consequently, the protuberance 25 in the captor 22 separates from the end bevel 30 of the protuberance 29 to release its push-up action against the captor 22, allowing the latter to touch down to a central position on the board surface as shown by the solid lines in FIG. 4. It will be noted that, of all the captors 22, only the one which has successfully reached the position just above the ball 38 can capture that ball.

If the lever 31 is freed when the captor 22 has touched down on the board surface, said lever is forced back to its original position by the elastic action of spring 35, and hence the rearmost end of the actuator plate 26 pushes the rear end plate 43 of the push-out member 16 to let it move back into the body portion 8, allowing the captor 22 to return to its original position shown by the solid line in FIG. 1. The ball 38 captured by a captor 22 falls down from said captor into the associated ball take-in hollow 41 and thence rolls down into the associated ball reservoir 42, and thus one ball capturing game is ended.

This ball capturing game may be continued by repeating the above-said operations.

The configuration of the board 1, body portions 8 and captors 22 as well as the number of said captors 22 and body portions 8 can be changed as desired. Also, each lever 31 may not necessarily be loaded with a spring, and instead, arrangement may be made such that ejection and return of each push-out member may be effected by a manual operation of the lever 31.

In playing the game with the game board of this invention, several children gather around the board, each child being seated in front of a captor, and each player operates the lever extending out from the body portion of the captor to push out said captor, trying to capture the booty such as ball delivered to the center of the board. Thus, the children can enjoy the thrill of getting the booty by vying with each other. Further, the movements of the captors are very amusing as each captor modeled after the head of an animal rushes toward the center of the board with the bottom opening (resembling the mouth of the animal) of said captor being kept in an opened-out condition and behaves just like it swallows up the booty by shutting down the bottom opening at a point just before the captor reaches a central part of the board surface. The game board of this invention, therefore, allows the children to play a very joyful and exciting game.

What is claimed is:

1. A game board comprising:

(a) an extended base board with a surface, a defined periphery, a defined board center, and ball delivery means to deliver a ball towards said board center;

(b) a plurality of hollow structures modeled after the body portion of an animal or otherwise shaped and disposed at the base board periphery with a slant groove therein extending towards said board center;

(c) A push-out member for each hollow structure, each push out member comprising fore and rear ends, and an upper frame astride said slant groove, a bottom in each of said hollow structures, said bottom being slidably mounted in said slant groove so that said push-out member may be pushed out of said hollow structure towards said board center, a capturing structure shaped like the head of an animal or otherwise, pivotally joined to said push-out member fore end, said capturing structure having a bottom opening which normally engages the board surface and a capturing structure interior upper part with a protuberance at said upper part which when engaged will pivot said capturing structure and raise said bottom opening.

(d) an actuator plate loosely fitted in each of said push-out members so that said plate is reciprocatively movable between the fore and rear ends of said push out member, guide chamber means at the fore end of said push out member and within said capturing structure to guide the fore portion of said actuator plate towards said protuberance;

(e) a protuberant and beveled fore end on each of said actuator plates disposed to enter said guide chamber means and hit the protuberance in said capturing structure so as to raise the capturing structure from the board surface when the actuator plate is moved from the rear end to the fore end of the push-out member; and, (f) a lever for each push-out member, each having one end engaged with the associated actuator plate, the other end projecting out from the associated animal body-shaped hollow structure with a lever center portion pivoted to said upper frame at said push-out member rear end so that when the projecting portion thereof is moved back and forth, its end engaged with said associated actuator plate operates to force out the corresponding push-out member from said associated hollow structure through said actuator plate and spring means coupled to said lever tending to return said push-out member to its original position.

2. A game board set forth in claim 1, wherein the base board ball delivery means is provided with portions like receptacles for holding balls, each of said receptacle-like portions being provided with a portion for delivering therefrom a ball toward the center of the board, and ball reservoirs each of which is connected to a ball take-in hollow opened at that position on the board surface where the associated capturing structure returns after having been ejected out by the corresponding push-out member.

* * * * *